US006378483B1

(12) United States Patent
Kato

(10) Patent No.: US 6,378,483 B1
(45) Date of Patent: Apr. 30, 2002

(54) LUBRICATION SYSTEM FOR FOUR-STROKE ENGINE

(75) Inventor: Masaki Kato, Iwata (JP)

(73) Assignee: Yamaha Hatsudoki Kabushiki Kaisha (JP)

( * ) Notice: Subject to any disclaimer, the term of this patent is extended or adjusted under 35 U.S.C. 154(b) by 0 days.

(21) Appl. No.: 09/603,026

(22) Filed: Jun. 26, 2000

(30) Foreign Application Priority Data

Jun. 25, 1999 (JP) ..... 11-179708

(51) Int. Cl.[7] ..... F01M 1/00

(52) U.S. Cl. ..... 123/196 R; 123/90.34; 123/195 C

(58) Field of Search ..... 123/196 R, 196 M, 123/90.34, 90.37, 90.38, 195 C; 184/6.5, 6.9

(56) References Cited

U.S. PATENT DOCUMENTS 4,430,968 A 2/1984 Futakuchi et al.
4,592,314 A 6/1986 Tsuchida
4,602,595 A * 7/1986 Aoki et al. ..... 123/41.86
RE32,582 E 1/1988 Futakuchi et al.
4,928,641 A * 5/1990 Niizato et al. ..... 123/90.16
5,161,495 A 11/1992 Saito
RE35,382 E 11/1996 Saito
5,704,330 A 1/1998 Tsuchida
6,173,689 B1 1/2001 Tanaka

* cited by examiner

*Primary Examiner*—Tony M. Argenbright
*Assistant Examiner*—Katrina B. Harris
(74) *Attorney, Agent, or Firm*—Knobbe, Martens, Olson & Bear, LLP

(57) ABSTRACT

A four-stroke engine with a lubrication system is disclosed. The engine includes intake and exhaust valves. A valve actuating mechanism opens and closes the intake and exhaust valves. The lubrication system includes a baffle plate unit that is located generally above the valve actuating mechanism. The baffle plate unit includes a baffle pate and a lubrication passage. The baffle plate is configured to guide blow-by vapors to a discharge port. The lubrication passage is configured to lubricate the valve actuating mechanism.

24 Claims, 11 Drawing Sheets

LUBRICATION SYSTEM FOR FOUR-STROKE ENGINE

PRIORITY INFORMATION

The present application is based on and claims priority to Japanese Patent Application No. 11-179708, which was filed on Jun. 25, 1999, the entire contents of which is hereby expressly incorporated by reference.

BACKGROUND OF THE INVENTION

1. Field of the Invention

This invention relates to an internal combustion engine and, in particular, to an arrangement for providing lubricant to a valve actuating mechanism of the internal combustion engine.

2. Description of the Related Art

The intake and exhaust valves of a typical four-stroke engine are opened and closed by a valve actuating mechanism. The valve actuating mechanism typically includes a cam shaft that is driven by a crankshaft. The cam shaft includes cam lobes that engage a follower mechanism for opening and closing the valves either directly or through an intermediate mechanism such as a tappet, a push rod or a rocker arm. The operating load on the valve actuating mechanism is particularly high especially in the area where the cam lobe contacts the follower mechanism. It is, therefore, necessary to provide lubricant to the valve actuating mechanism and, in particular, to the area where the cam lobe contacts the follower mechanism.

One arrangement for lubricating this area involves providing a lubricant passage in the cam shaft. The lubricant passage in the cam shaft communicates with a lubricant passage in the cam lobe, which has an opening located where the cam lobe contacts the follower mechanism. This arrangement, however, has several disadvantages. For example, when the cam lobe is not engaged with the follower mechanism, a substantial amount of lubricant is discharged through the opening on the cam lobe. This significantly reduces the lubricant pressure in the lubricant system. In addition, the edges of the opening can damage to the follower mechanism. Moreover, this arrangement provides little design flexibility with respect to where the lubricant is applied to the valve actuating mechanism.

Another arrangement for lubricating the valve actuating mechanism includes a lubricant pipe that is secured to the cylinder head by one or more supports. The lubricant pipe includes a lubricant passage and injection holes that are directed towards the valve actuating mechanism. Accordingly, lubricant flows through the lubricant pipe and is sprayed onto the valve actuating mechanism through the injection holes. Although this arrangement provides additional design flexibility, it also has several disadvantages. In particular, it is difficult to assemble and to disassemble. Moreover, because the pipe is secured directly to the cylinder, this arrangement is subjected to the vibration generated by the valve drive system.

SUMMARY OF THE INVENTION

It is, therefore, an object of the present invention to provide an improved arrangement for lubricating the valve actuating mechanism. Accordingly, one aspect of the of the present invention involves a four-cycle engine having a lubrication system. The engine comprises a cylinder block that has at least one cylinder. A piston is arranged for reciprocation within the cylinder and is connected to an output shaft. A head assembly is connected to the cylinder block. At least one combustion chamber is defined between the head assembly and the piston. At least one intake port and at least one exhaust port communicates with the combustion chamber. An intake valve is capable of closing and opening the intake port and an exhaust valve is capable of closing and opening the exhaust port. The engine also includes a valve actuating mechanism that includes an intake cam shaft capable of moving the intake valves and an exhaust cam shaft capable of moving the exhaust valves. A head cover is positioned over the valve actuating mechanism and defines, in part, a cam chamber. The lubrication system comprises a baffle plate unit located within the cam chamber above the valve actuating mechanism. The baffle plate unit includes a baffle plate that partially defines a path leading towards a discharge port for blow-by vapors from the combustion chamber. The baffle plate unit includes a lubricant passageway that is in communication with a lubrication system of the engine. The lubricant passageway is configured to supply lubricant to valve actuating mechanism.

Another aspect of the of the present invention involves a four-cycle engine that has a lubrication system. The engine comprises a cylinder block that has at least one cylinder. A piston is arranged for reciprocation within the cylinder and is connected to an output shaft. A head assembly is connected to the cylinder block. At least one combustion chamber is defined between the head assembly and the piston. At least one intake port and at least one exhaust port communicate with the combustion chamber. An intake valve is capable of closing and opening the intake port and an exhaust valve is capable of closing and opening the exhaust port. The engine also includes a valve actuating mechanism that includes an intake cam shaft capable of moving the intake valves and an exhaust cam shaft capable of moving the exhaust valves. A head cover is positioned over the valve actuating mechanism and defines, in part, a cam chamber. The lubrication system comprises a baffle plate unit that is located within the cam chamber generally above the valve actuating mechanism. The baffle plate unit includes a baffle plate that defines, along with the head cover, a path to a discharge port for blow-by vapors from the combustion chamber. The baffle plate unit includes means for the lubricating valve actuating mechanism.

BRIEF DESCRIPTION OF THE DRAWINGS

These and other features of the invention will now be described with reference to the drawings of the preferred embodiments, which are intended to illustrate and not to limit the invention, and in which.

DETAILED DESCRIPTION OF THE PREFERRED EMBODIMENT

The present invention relates primarily to an arrangement for providing lubricant to a valve actuating mechanism 8 of an internal combustion engine 10. Therefore, only the portions of the engine which form the arrangement are illustrated. Where any details of the construction of the engine 10 are not illustrated or described, those skilled in the art can readily practice the invention by resort to known technologies for those components and their interaction with the remaining components of the engine 10.

Figure 1:
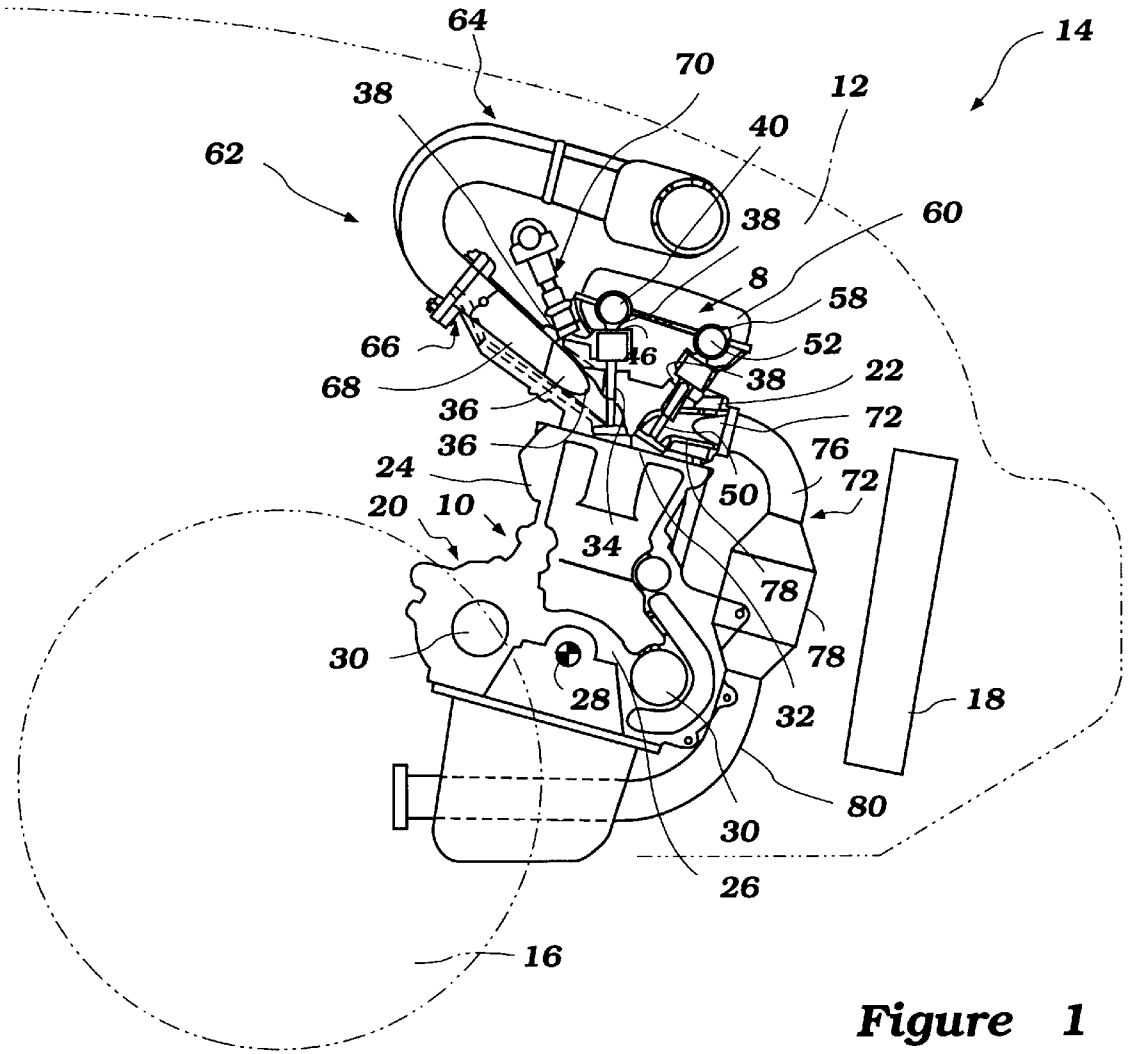
FIG. 1 is a partially cross-sectioned side view of an internal combustion engine located within a front portion of a vehicle.

With initial reference to FIG. 1, the engine 10 is provided in an engine compartment 12 of a vehicle 14. In the illustrated embodiment, the vehicle 14 is automobile and the engine 12 is located generally forward of the front wheels 16 and behind a radiator 18. Although the engine 10 is illustrated in an automobile, those skilled in the art will readily appreciate that the features of the present invention can also have utility in a wide variety of other settings, for example, without limitation, personal watercraft, outboard motors, and motorcycles.

The engine 10 is a two cylinder, in-line, four-stroke engine. However, it should be appreciated that several features and advantages of the present invention can be used in an engine with a different cylinder configuration (e.g., in-line or opposed) and/or a different number of cylinders (e.g., six).

With continued reference to FIG. 1, the engine 10 is formed from an engine body 20 having a cylinder head 22, a cylinder block 24 and a crankcase 26. The crankcase 26 defines a crankcase chamber (not shown). The cylinder block 24 is formed with two cylinder bores (not shown). A piston (not shown) is provided within each cylinder bore and is supported for reciprocal movement therein. Piston pins (not shown) connect the pistons to respective connecting rods (not shown). The connecting rods are journaled on the throws of a crankshaft 28. The crankshaft 28 is journaled by a plurality of bearings within the crankcase 26 to rotate about a crankshaft axis that, in the illustrated arrangement, lies transverse to a longitudinal axis of the vehicle. Preferably, balancer shafts 30 are provided on both sides of the crankshaft 28 to reduce engine vibration.

The cylinder head 22 is provided with individual recesses that cooperate with the respective cylinder bores and the heads of the pistons to form combustion chambers 32. These recesses are surrounded by a lower cylinder head surface that is planar and held in sealing engagement with the cylinder block 24, or with cylinder head gaskets (not shown) interposed therebetween, in a known manner. This planar surface of the cylinder head may partially override the cylinder bores to provide a squish area, if desired. The cylinder head 22 may be affixed to the cylinder block 24 in any suitable manner.

Poppet-type intake valves 34 are slidably supported in the cylinder head 22 in a known manner, and have their head portions engageable with valve seats so as to control the flow of an intake charge into the combustion chambers 32 through intake passages 36 formed in the cylinder head 22. The intake valves 34 are biased toward their closed position by coil compression springs 38. The valves 34 are opened and closed by the valve actuating mechanism 8. The valve actuating mechanism includes an intake camshaft 40. The intake cam shaft 40 is suitably journaled in the cylinder head 22 with bearings 42 (see FIG. 3). The intake camshaft 40 has lobes 46 that open and close the intake valves 34 by contacting thimble tappets. Specifically, as the lobes 46 press downward on the tappets, the valves 34 open and as the lobes 46 rotate away the springs 38 close the valves 34.

The intake camshaft 40 is driven by the crankshaft 28 via a camshaft drive mechanism (not shown). In particular, the camshaft drive mechanism preferably includes a timing belt that couples the crankshaft 28 to the intake camshaft 40.

With continued reference to FIG. 1, the cylinder head 22 includes at least one exhaust passage 48 for each combustion chamber 32. The exhaust passages 48 emanate from one or more valve seats formed in the cylinder head 22. At least one exhaust valve 50 for each combustion chamber 32 is supported for reciprocation in the cylinder head 22, in a manner similar to the intake valves 34. The exhaust valves 50 also are biased toward their closed position by coiled compression springs 38. The valve actuating mechanism also opens and closes the exhaust valves 38. Accordingly, the actuating mechanism includes an overhead mounted exhaust camshaft 52. As with the intake camshaft 40, the exhaust camshaft 52 is also suitably journaled for rotation in the cylinder head 22 with bearings 54 (see FIG. 3). The exhaust cam shaft 52 includes cam lobes 58 that cooperate with thimble tappets for operating the exhaust valves 50 in a known manner. In the illustrated engine, the rotational axis of the intake camshaft 40 and the exhaust camshaft 52 are generally parallel to each other. Like the intake camshaft 40, the crankshaft 28 drives the exhaust camshaft 52 in a known manner.

A cylinder head cover 60 encloses the camshafts 40, 52 and is sealably engaged with an upper surface of the cylinder head 22. As such, the cylinder head cover 60 protects the camshafts 40, 52 from foreign material such as dirt, dust, and debris. The cylinder head cover 60 at least partially defines a cam chamber 61 in which the valve actuating mechanism 8 is located. Certain features of the cylinder head cover 60 will be described in more detail below.

A suitable ignition system is provided for igniting an air and fuel mixture that is provided to each combustion chamber 32. As is well known in the art, the ignition system typically includes spark plugs (not shown) that are preferably fired by a suitable ignition control system.

The engine 10 also includes an air intake system 62 that delivers air to the combustion chambers 32. The air intake system 62 includes an intake manifold 64. Downstream of the intake manifold 64, is a throttle body 66, which is used in a known manner to control the amount of air delivered to the combustion chambers 32. The throttle body 66 is connected to an air passage 68 that branches into the intake passages 36, which are connected to the respective combustion chambers 32.

The engine 10 also includes a fuel system that delivers fuel to the combustion chambers 32. In the illustrated engine, the fuel system includes fuel injectors 70, which are disposed in the cylinder head 22. The fuel injectors 70 are supplied with fuel from a fuel supply in a known manner. The fuel injectors 70 are also controlled by a fuel control system in known manner. Although the illustrated engine utilizes direct fuel injection, those of skill in the art will readily appreciate that the features and advantages of the present invention can be achieved in an engine that utilizes a carburetor or indirect injection.

The engine 10 also includes an engine exhaust system 72 to guide the exhaust gases produced by the engine 10 to the atmosphere. The engine exhaust system 72 includes the exhaust passages 48 that communicate with each of the combustion chambers 32. The exhaust passages 48 join together in an exhaust manifold, which in the illustrated engine 10 is formed integrally with the engine block 22. The exhaust manifold is connected to an exhaust pipe 76, which is connected to a catalyst 78. The catalyst 78 is connected to a second exhaust pipe 80, which guides the exhaust gases to the rear of the vehicle 14.

FIGS. 2–8 illustrate a lubrication system 100 for providing lubricant to the engine 10. The lubrication system 100 has certain features and advantages according to the present invention. The general layout of the lubrication system 100 will be described with reference to the schematic illustration of the lubrication system in FIG. 2. The lubrication system 100 includes an lubrication pump 102 that is preferably mounted to the engine body 20. The lubrication pump 102 can be of any known type. The lubrication pump 102 withdraws lubricant that has collected in a lubrication pan 104 through a first lubricant passage 106. The lubricant pan 104 is located below the crank case 26 (see also FIG. 1) and is configured to collect lubricant from the crankcase chamber as is well known in the art. Preferably, the lubricant is drawn from a reservoir (not shown), or pan 104, though an intake having a mesh screen or filter (not shown).

The lubricant pump 102 supplies lubricant to several areas of the engine 10 such as, for example, the pistons and the crankshaft 28 through various lubricant galleries (not shown) formed in the engine body 20. Preferably, the lubricant pump 102 also supplies lubricant to a lubrication passage 106 formed in the intake cam shaft 40 and a lubricant passage 108 formed in the exhaust cam shaft 52 (see FIG. 5). The lubricant pump 102, preferably, supplies lubricant to these passages 106, 108 from a second lubricant passage 110, which extends through the cylinder block 24 and the cylinder head 22. The second lubricant passage 110 communicates with a third lubricant passage 112, which extends generally perpendicular to the intake and exhaust cam shafts 40, 52. Branch passages 114, 116, (see also FIG. 3) connect the third lubricant passage 112 with the lubrication passages 106, 108 formed in the intake and exhaust cam shafts 40, 52.

Figure 2:
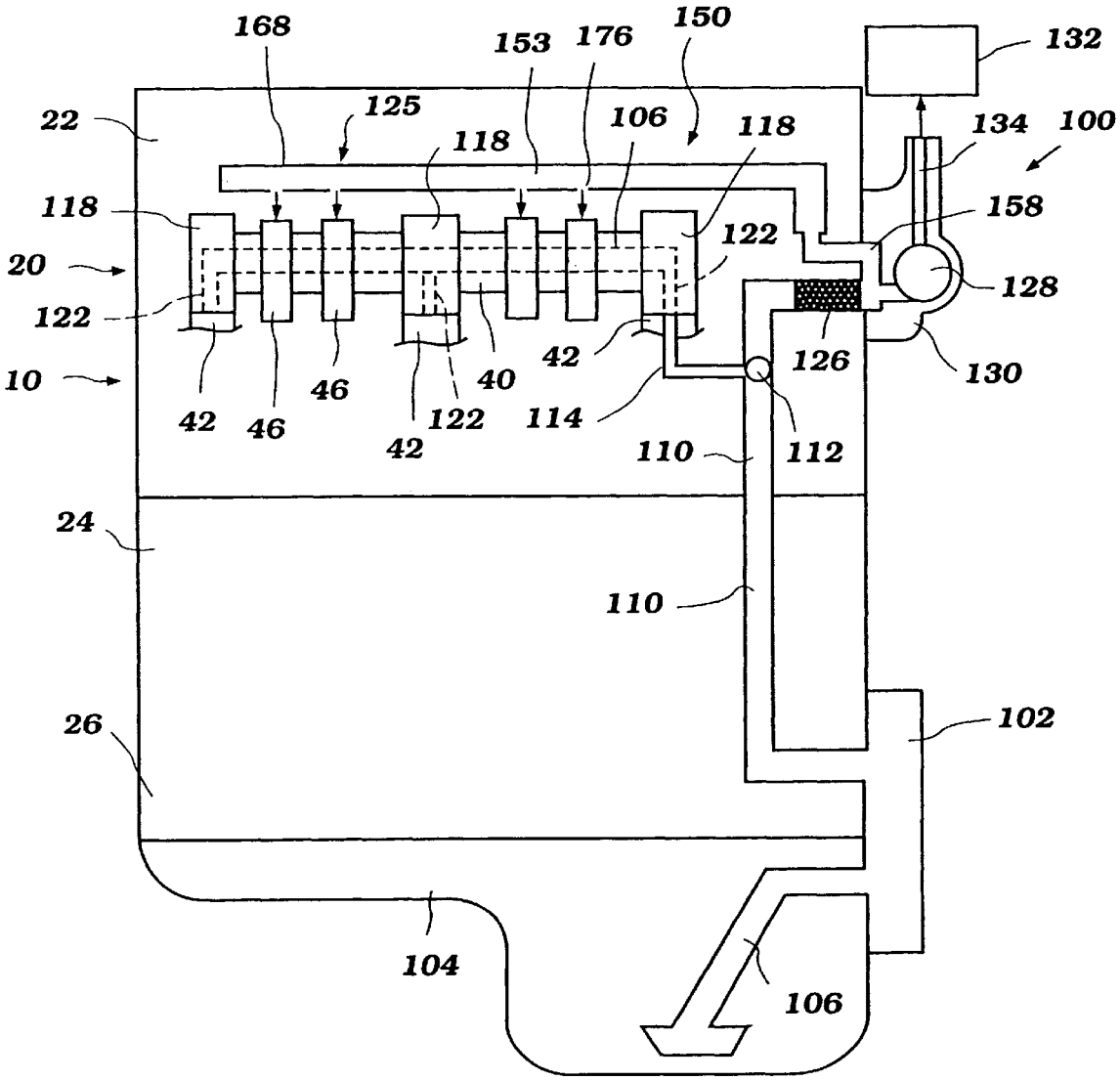
FIG. 2 is a schematic diagram that illustrates the lubrication system of the engine.
Figure 4:
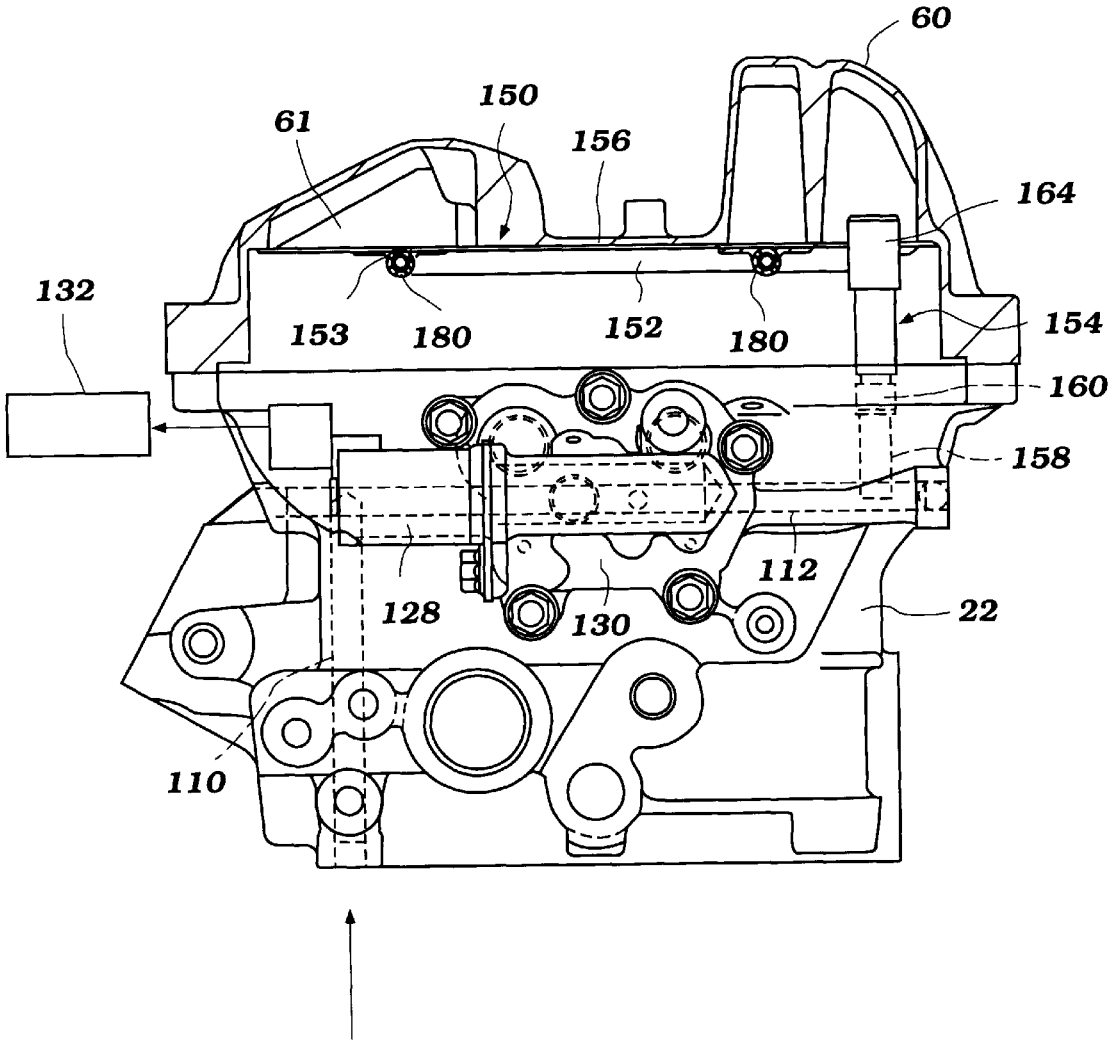
FIG. 4 is a partially cross-sectioned side view of the cylinder head and the head cover.
Figure 5:
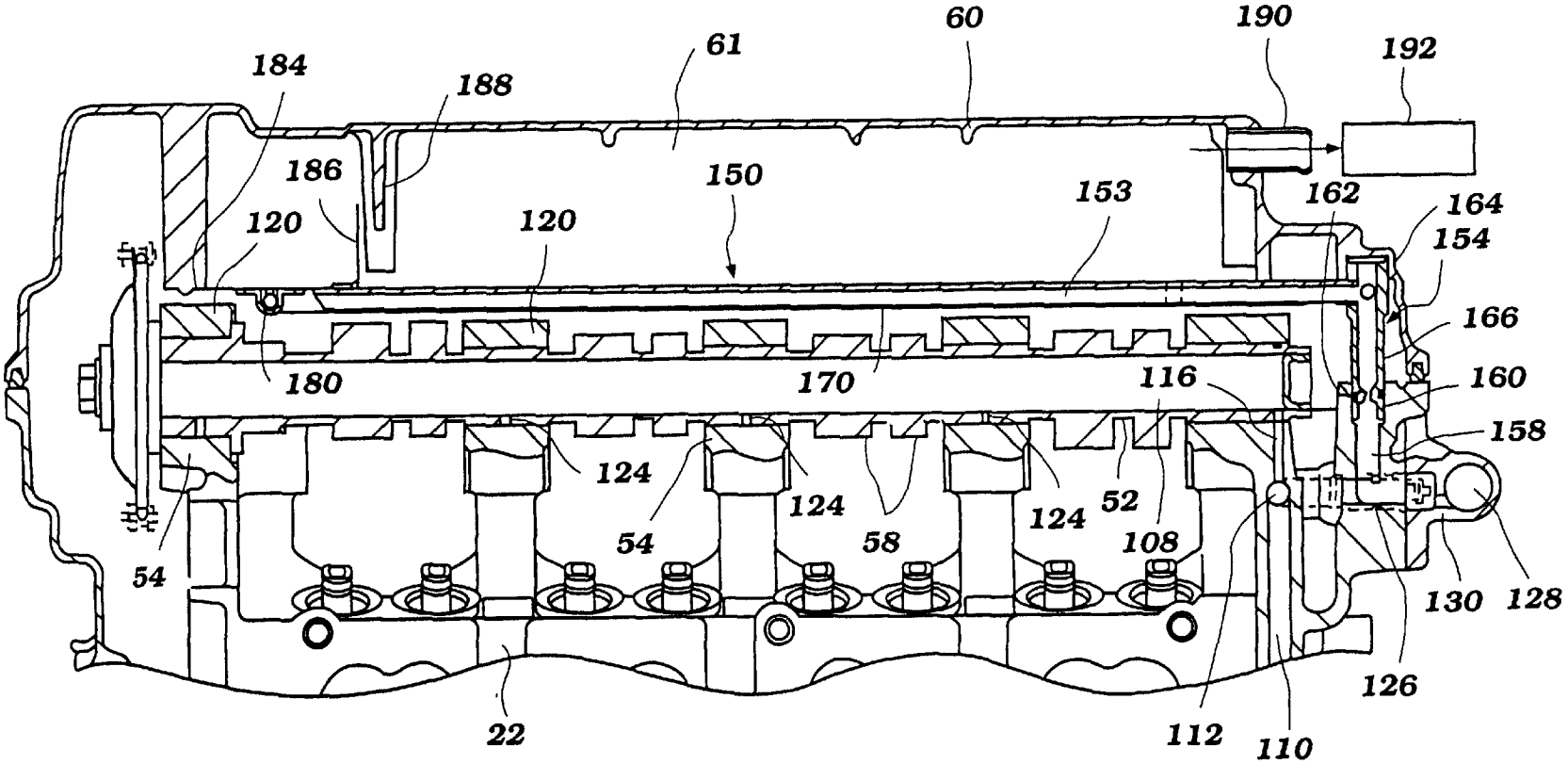
FIG. 5 is a cross-sectional side view of the cylinder head and the head cover taken along a longitudinal axis of the engine.

As best seen in FIGS. 2, 4, and 5, the intake and exhaust cam shafts 40, 52 include cam caps 118, 120, which are suitably journaled for rotation within bearings 42, 54. The cam caps 118, 120 include lubrication passages 122, 124, that are in communication with the lubrication passages 106, 108 of the intake and exhaust cam shafts 40, 52. Accordingly, the lubrication passages 122, 124 provide lubricant to the bearings 42, 54.

With reference to FIG. 2, the lubrication system 100 preferably also includes a filter 126 that is in communication with the second lubrication passage 110. The filter 126 is preferably located within a housing 130, which preferably is attached to the side wall of the cylinder head 22. In this position, the filter 130 can be easily replaced or serviced. If desired, the lubrication system 100 can include a control valve 128 that is in communication with the filter 126. The control valve 128 is adapted to control the supply of lubricant to a variable cam mechanism 132. As is known in the art, the control valve 128 can be utilized to adjust the timing of the intake and/or exhaust valves 34, 50 through a variable cam mechanism 132. A lubrication passage 134 connects the control valve 128 to the variable cam mechanism 132.

With reference to FIGS. 2–8, the lubrication system includes a baffle plate unit 150 having certain features and advantages according to the present invention. As will be explained in detail below, the baffle plate unit 150 is configured to supply lubricant to the valve actuating mechanism 8 and, in particular, the intake and exhaust lobes 46, 58.

With reference now to FIGS. 3–6, the baffle plate unit 150 includes a first lubrication pipe 152 and a second lubrication pipe 154. The first and second lubrication pipes 152, 154 are connected together and are coupled to a baffle plate 156, which also forms part of the baffle plate unit 150. The first and second lubrication pipes 152, 154 form a lubricant passage 153. Preferably, lubricant is supplied to the lubricant passage 153 through a fourth lubrication passage 158, which preferably extends from the filter 126. In the illustrated arrangement, an end 160 of the second lubrication pipe 154 is connected to the fourth lubrication passage 158 formed in the cylinder head 22 through a sealing member 162 or an 0-ring. The other end 164 of the second lubrication pipe 154 is preferably fitted within the cylinder head cover 60 as best seen in FIG. 5.

Figure 3:
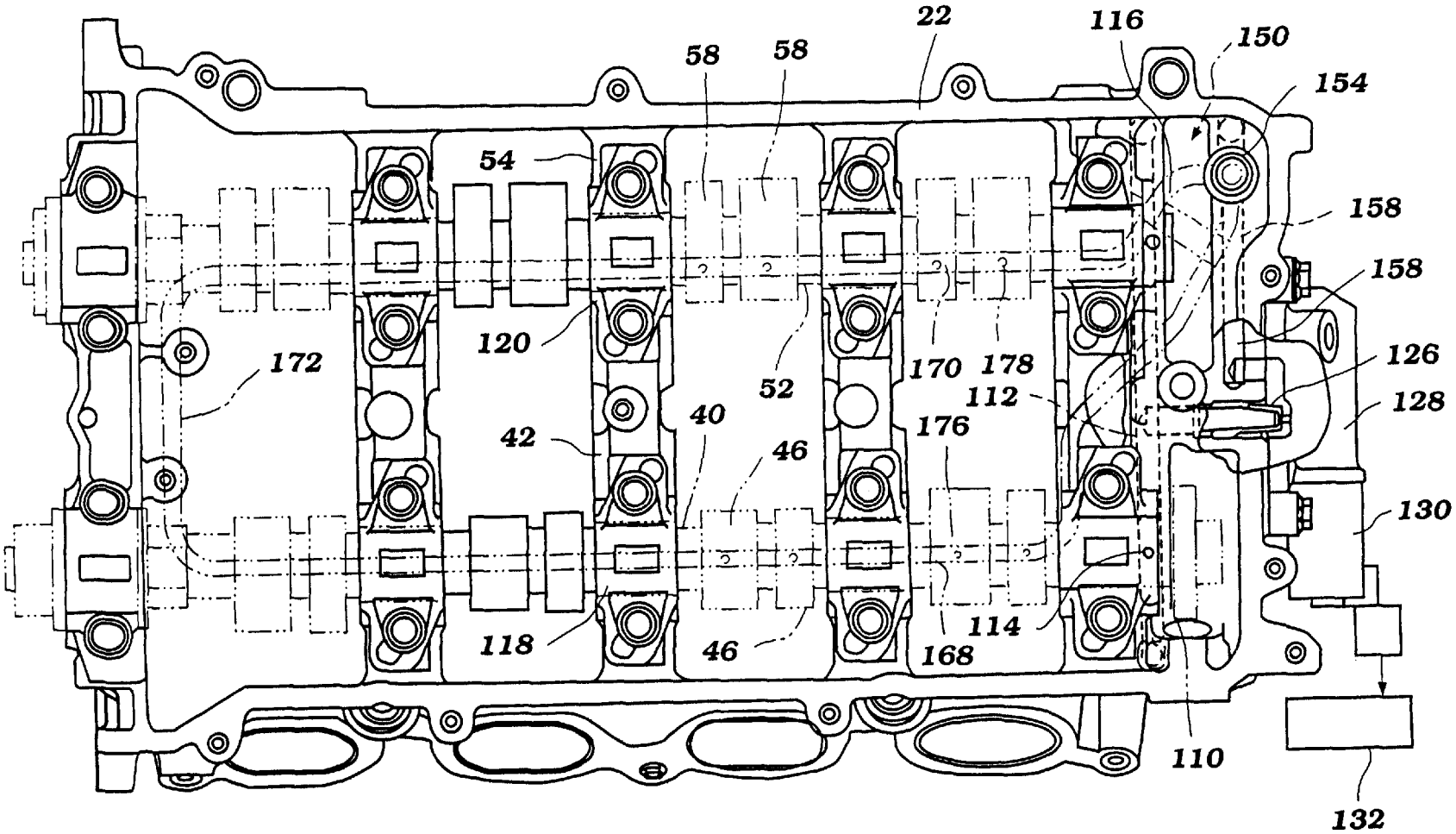
FIG. 3 is a top plan view of a cylinder head with a head cover removed.

The lubricant flow rate in the lubrication passage 153 preferably is regulated by an orifice 166 that is preferably located in the second lubrication pipe 154. As best seen in FIG. 3, the first lubrication pipe 152 preferably is formed from a single member and includes two straight sections 168, 170 that are disposed above the intake and exhaust cam shafts 40, 52 respectively. The first lubrication pipe 152 preferably also includes a connecting section 172 that connects the two straight sections 168, 170. Accordingly, the first lubrication pipe 152 generally forms a ring. Preferably, the connecting section 172 is configured to reduce the magnitude of the bend to reduce pressure loss in the lubrication system 100. The first lubrication pipe 152 also includes additional bent sections 174 that are also configured to reduce pressure loss.

The straight sections 168, 170 include injection holes 176, 178 that are generally located above the lobes 46, 58 of the intake and exhaust cam shafts 40, 52. Accordingly, lubricant supplied to the lubrication passage 153 is directed towards the valve actuating mechanism, specifically in the area of the lobes 46, 58. Because the straight sections 168, 170 form a continuous lubrication passage 153, the lubrication pressure in the lubrication passage 153 is generally uniform with respect to the intake and exhaust sides.

Figure 6:
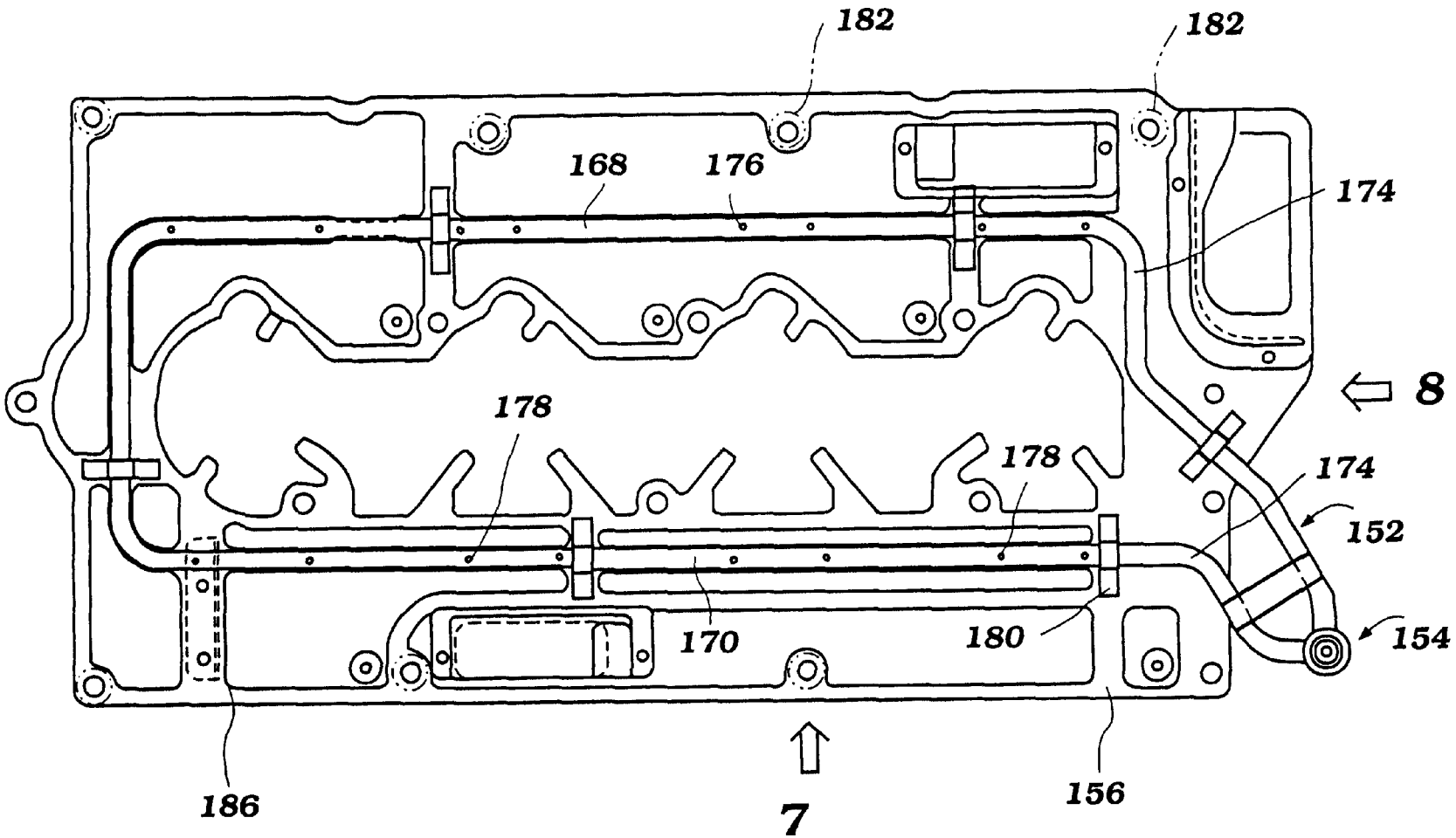
FIG. 6 is a bottom plan view of a baffle plate.
Figure 7:
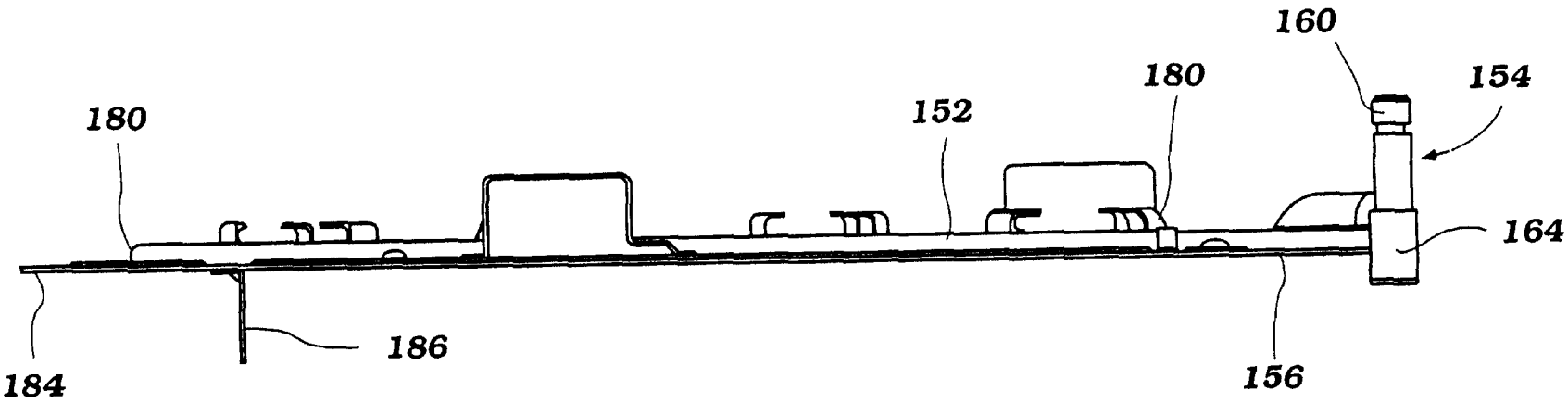
FIG. 7 is a side view of the baffle plate as seen in the direction of an arrow 7 of FIG. 6.
Figure 8:
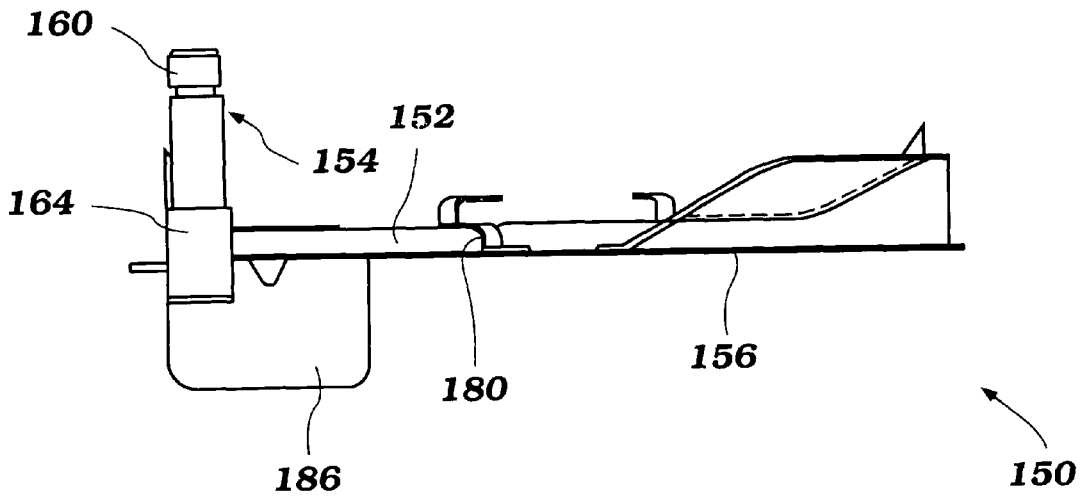
FIG. 8 is a side view of the baffle plate as seen in the direction of an arrow 8 of FIG. 6.
Figure 9A:
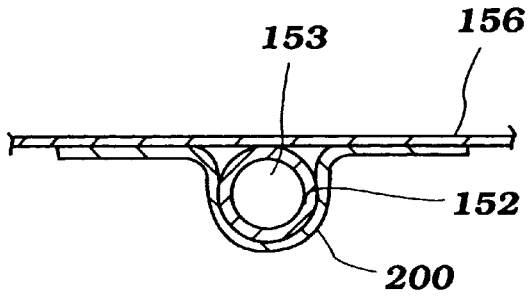
FIGS. 9A and 9B illustrate a modified arrangement of a baffle plate unit.
Figure 9B:
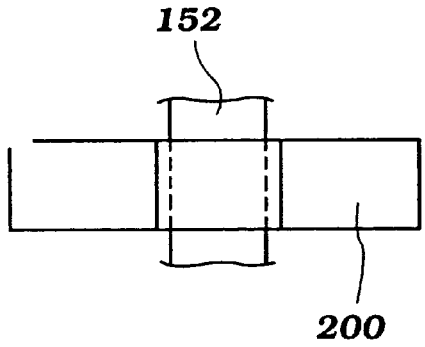
Figure 10A:
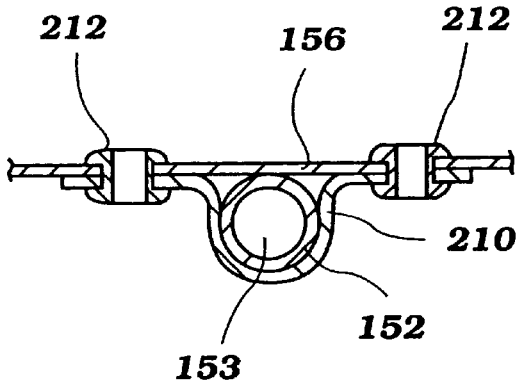
FIGS. 10A and 10B illustrate another modified arrangement of the baffle plate unit.
Figure 10B:
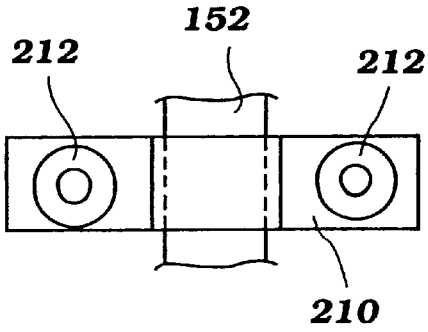
Figure 11A:
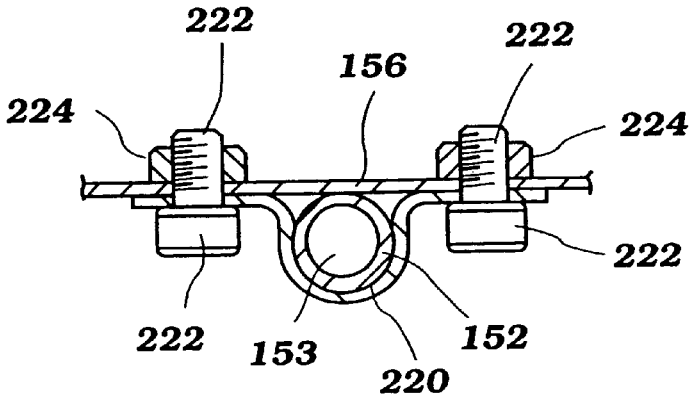
FIGS. 11A and 11B illustrate still another modified arrangement of the baffle plate unit.
Figure 11B:
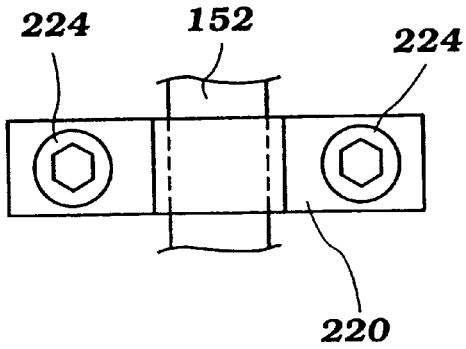

As best seen in FIGS. 3–8, the first and second lubrication pipes 152, 154 are secured to the baffle plate 156 by fixtures 180. With particular reference to FIGS. 5 and 6, the baffle plate 156 preferably is fastened with screws 182 to the cylinder head cover 60. Preferably, a portion 184 of the baffle plate 156 is fixed to the cylinder head cover 60 by caulking.

As is well-known in the art, blow-by-vapors leak into the cam chamber 61 from the combustion chambers 32. To separate lubrication droplets from the blow-by vapors, the baffle plate 156 includes a baffle board 186 (see FIG. 5), which is disposed opposite a baffle section 188 that protrudes inwardly from the cylinder head cover 60. The baffle plate 156, the baffle board 186 and the baffle section 188 create a torturous path for the blow-by vapors that are trapped in the cam chamber 61. This tortuous path separates a majority of the lubrication droplets from the blow-by vapors before the blow-by vapors are discharged from the cam chamber 61 though a discharge port 190 formed in the cylinder head cover 60. The blow-by vapors are returned to the intake system 62 through a circulation passage 192, which is connected to the discharge port 190.

The baffle plate unit 150 described above provides flexibility in the design of the lubrication passage 153. That is, the engine designer can relatively easily modify the configuration of the lubrication passage 153 and the configuration of the injection holes 176, 178 so as to change the amount and way the lubricant is applied to the valve actuating mechanism. Moreover, the lubrication passage 153 formed by the first and second lubrication pipes 152, 154 can be easily attached and detached together with the baffle plate 156. In addition, because, the baffle plate is not directly attached to the valve drive system, vibration on the lubrication passage 153 is reduced. This improves the reliability of the lubrication system 100.

Figure 12A:
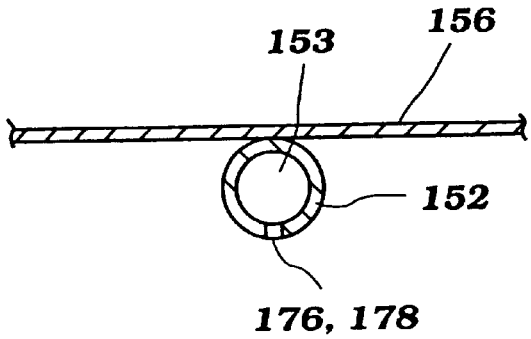
FIGS. 12A and 12B illustrate yet another modified arrangement of the baffle plate unit.
Figure 12B:
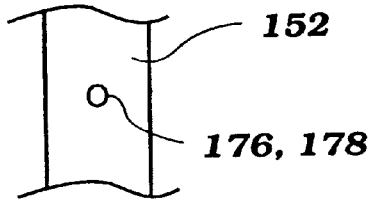

FIGS. 9A–12B illustrate modified arrangements for attaching the first lubrication pipe 152 to the baffle plate 156. Specifically, in FIGS. 9A and 9B, the fixtures 200, which preferably are welded to the baffle plate 156, secure the first lubrication pipe 152 to the baffle plate 156. In FIGS. 10A and 10B, the fixtures 210 preferably are riveted to the baffle plate 156 with rivets 212. In FIGS. 11A and 11B, the fixtures 220 preferably are fastened to the baffle plate 156 with bolts 222 and nuts 224. In FIGS. 12A and 12B, the lubrication pipe 152 is directly attached to the baffle plate 156, such as by welding.

Figure 13A:
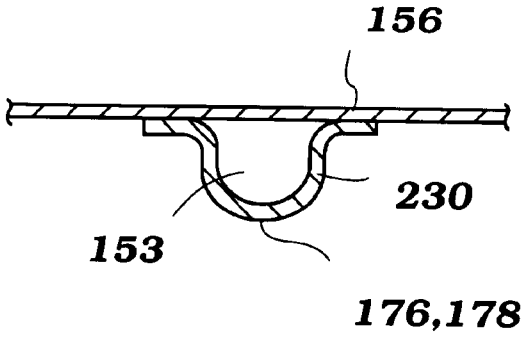
FIGS. 13A and 13B illustrate a further modified arrangement of the baffle plate unit.
Figure 13B:
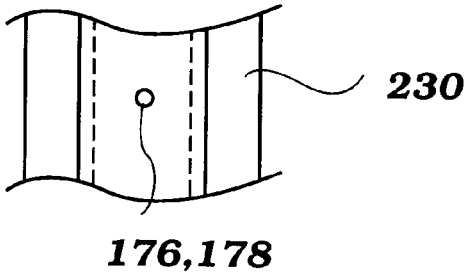

FIGS. 13A and B illustrate another modified arrangement of the baffle plate unit 150. In this arrangement the lubrication passage 153 is formed from the baffle plate 156 and a metal sheet 230 that is preferably press-formed and brazed to the baffle plate 156. Although the in the illustrated arrangement, the metal sheet 230 is brazed to the baffle plate 156, adhesives can also be used to secure the sheet 230 to the baffle plate 156. Note that the injection holes 176, 178 are formed in the metal sheet 230. In this arrangement, the lubrication passage 153 is formed from a small number of components. It is also anticipated that the passage 153 can be formed on the other side of the baffle plate 156 with the injection holes 176, 178 extending through the baffle plate 156.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Moreover, although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A four-cycle engine having a lubrication system, the engine comprising a cylinder block, the cylinder block having at least one cylinder, a piston arranged for reciprocation within the cylinder and connected to an output shaft, a head assembly connected to the cylinder block, at least one combustion chamber defined between the head assembly and the piston, at least one intake port and at least one exhaust port communicating with the combustion chamber, an intake valve capable of closing and opening the intake port, an exhaust valve capable of closing and opening the exhaust port, a valve actuating mechanism that includes an intake cam shaft capable of moving the intake valves and an exhaust cam shaft capable of moving the exhaust valves, a head cover positioned over the valve actuating mechanism and defining, in part, a cam chamber, the lubrication system comprising a baffle plate unit located within the cam chamber above the valve actuating mechanism, the baffle plate unit includes a baffle plate that at least partially defines a path leading towards a discharge port for blow-by vapors from the combustion chamber, the baffle plate unit including a lubricant passageway that receives lubricant from the lubrication system of the engine, the lubricant passageway configured for supplying lubricant to the valve actuating mechanism.

2. A four-cycle engine as in claim 1, wherein the intake and exhaust cam shafts include lobes for opening and closing the intake and exhaust valves and wherein the lubricant passageway includes one or more openings located generally above the lobes.

3. A four-cycle engine as in claim 1, wherein the lubricant passageway is defined by a lubricant pipe attached to the baffle plate.

4. A four-cycle engine as in claim 3, wherein the pipe includes an intake side and an exhaust side that are in communication with each other forming a ring.

5. A four-cycle engine as in claim 1, wherein the lubricant passageway is defined at least in part by the baffle plate.

6. A four-cycle engine as in claim 5, wherein the lubricant passage way includes an intake side and an exhaust side that are in communication with each other forming a ring.

7. A four-cycle engine as in claim 5, wherein the lubricant passageway is defined at least in part by the baffle plate and a piece of sheet metal attached to the baffle plate.

8. A four-cycle engine having a lubrication system, the engine comprising a cylinder block, the cylinder block having at least one cylinder, a piston arranged for reciprocation within the cylinder and connected to an output shaft, a head assembly connected to the cylinder block, at least one combustion chamber defined between the head assembly and the piston, at least one intake port and at least one exhaust port communicating with the combustion chamber, an intake valve capable of closing and opening the intake port, an exhaust valve capable of closing and opening the exhaust port, a valve actuating mechanism including an intake cam shaft capable of moving the intake valves and an exhaust cam shaft capable of moving the exhaust valves, a head cover positioned over the valve actuating mechanism and defining, in part, a cam chamber, the lubrication system comprising a baffle plate unit located within the cam chamber generally above the valve actuating mechanism, the baffle plate unit includes a baffle plate that defines, along with the head cover, a path to a discharge port for blow-by vapors from the combustion chamber, the baffle plate unit including means for supplying lubricant under pressure to the valve actuating mechanism.

9. A four-cycle engine as in claim 8, wherein the means includes a pipe attached to the baffle plate, the pipe including openings directed towards the intake and exhaust cams.

10. A four-cycle engine as in claim 8, wherein the means includes a piece of sheet metal attached to the baffle plate, the piece of sheet metal including openings directed towards the intake and exhaust cams.

11. A four-cycle engine having a lubrication system, the engine comprising a cylinder block, the cylinder block having at least one cylinder, a piston arranged for reciprocation within the cylinder and connected to an output shaft, a head assembly connected to the cylinder block, at least one combustion chamber defined between the head assembly and the piston, at least one intake port and at least one exhaust port communicating with the combustion chamber, an intake valve capable of closing and opening the intake port, an exhaust valve capable of closing and opening the exhaust port, a valve actuating mechanism that includes an intake cam shaft capable of moving the intake valves and an exhaust cam shaft capable of moving the exhaust valves, a head cover positioned over the valve actuating mechanism and defining, in part, a cam chamber, the lubrication system comprising a baffle plate unit located within the cam chamber above the valve actuating mechanism, the baffle plate unit includes a baffle plate that at least partially defines a path leading towards a discharge port for blow-by vapors from the combustion chamber, the baffle plate unit including a lubricant passageway that is located below the baffle plate and is in communication with a lubrication system of the engine, the lubricant passageway configured for supplying lubricant to the valve actuating mechanism.

12. A four-cycle engine as in claim 11, wherein the intake and exhaust cam shafts include lobes for opening and closing the intake and exhaust valves and wherein the lubricant passageway includes one or more openings located generally above the lobes.

13. A four-cycle engine as in claim 11, wherein the lubricant passageway is defined by a lubricant pipe attached to the baffle plate.

14. A four-cycle engine as in claim 13, wherein the pipe includes an intake side and an exhaust side that are in communication with each other forming a ring.

15. A four-cycle engine as in claim 11, wherein the lubricant passageway is defined at least in part by the baffle plate.

16. A four-cycle engine as in claim 15, wherein the lubricant passage way includes an intake side and an exhaust side that are in communication with each other forming a ring.

17. A four-cycle engine as in claim 15, wherein the lubricant passageway is defined at least in part by the baffle plate and a piece of sheet metal attached to the baffle plate.

18. A four-cycle engine having a lubrication system that includes a lubrication pump, the engine comprising a cylinder block, the cylinder block having at least one cylinder, a piston arranged for reciprocation within the cylinder and connected to an output shaft, a head assembly connected to the cylinder block, at least one combustion chamber defined between the head assembly and the piston, at least one intake port and at least one exhaust port communicating with the combustion chamber, an intake valve capable of closing and opening the intake port, an exhaust valve capable of closing and opening the exhaust port, a valve actuating mechanism that includes an intake cam shaft capable of moving the intake valves and an exhaust cam shaft capable of moving the exhaust valves, a head cover positioned over the valve actuating mechanism and defining, in part, a cam chamber, the lubrication system comprising a baffle plate unit located within the cam chamber above the valve actuating mechanism, the baffle plate unit includes a baffle plate that at least partially defines a path leading towards a discharge port for blow-by vapors from the combustion chamber, the baffle plate unit including a lubricant passageway, the lubricant pump supplying lubricant under pressure to the lubricant passageway and the lubricant passageway configured for supplying lubricant to the valve actuating mechanism.

19. A four-cycle engine as in claim 18, wherein the intake and exhaust cam shafts include lobes for opening and closing the intake and exhaust valves and wherein the lubricant passageway includes one or more openings located generally above the lobes.

20. A four-cycle engine as in claim 18, wherein the lubricant passageway is defined by a lubricant pipe attached to the baffle plate.

21. A four-cycle engine as in claim 20, wherein the pipe includes an intake side and an exhaust side that are in communication with each other forming a ring.

22. A four-cycle engine as in claim 18, wherein the lubricant passageway is defined at least in part by the baffle plate.

23. A four-cycle engine as in claim 22, wherein the lubricant passage way includes an intake side and an exhaust side that are in communication with each other forming a ring.

24. A four-cycle engine as in claim 22, wherein the lubricant passageway is defined at least in part by the baffle plate and a piece of sheet metal attached to the baffle plate.

* * * * *